US010470530B2

(12) United States Patent
Raccosta

(10) Patent No.: US 10,470,530 B2
(45) Date of Patent: Nov. 12, 2019

(54) DOUBLE-SIDED EYELET WITH VARIABLE HEIGHT

(71) Applicant: FIMMA S.P.A., Osnago (LC) (IT)

(72) Inventor: Gaetano Raccosta, Osnago (IT)

(73) Assignee: FIMMA S.P.A., Osnago (LC) (IT)

( * ) Notice: Subject to any disclaimer, the term of this patent is extended or adjusted under 35 U.S.C. 154(b) by 0 days.

(21) Appl. No.: 15/880,342

(22) Filed: Jan. 25, 2018

(65) Prior Publication Data

US 2018/0206601 A1 Jul. 26, 2018

(30) Foreign Application Priority Data

Jan. 26, 2017 (IT) ..... 102017000008478

(51) Int. Cl.
*A44B 13/00* (2006.01)
*A43B 23/24* (2006.01)
*A43C 5/00* (2006.01)

(52) U.S. Cl.
CPC ..... *A44B 13/0088* (2013.01); *A43B 23/24* (2013.01); *A43C 5/00* (2013.01); *A44B 13/0082* (2013.01)

(58) Field of Classification Search
CPC ..... A43B 23/24; A43C 5/00; A44B 13/0082; A44B 13/0088
See application file for complete search history.

(56) References Cited

U.S. PATENT DOCUMENTS 655,230 A * 8/1900 Hawkins ..... B65D 27/20 229/78.1
1,891,065 A * 12/1932 Sitton ..... A44B 13/0011 2/336

(Continued)

FOREIGN PATENT DOCUMENTS

JP 2014-200801 A 10/2014
KR 10-2011-0122019 A 11/2011
KR 10-2017-0058655 A 5/2017

OTHER PUBLICATIONS

Italian Patent Office Search Report and Written Opinion dated Aug. 16, 2017 (partially in English).

(Continued)

*Primary Examiner* — Robert Sandy
*Assistant Examiner* — David M Upchurch
(74) *Attorney, Agent, or Firm* — Hedman & Costigan, P.C.; James V. Costigan; Kathleen A. Costigan

(57) ABSTRACT

A double-sided eyelet, of having a first head (2) provided with an element (3) having a shank (4) and a second head (8) provided with an element (9) having a shank (10), wherein the aforesaid heads (2,8) are mutually closed on the hole (6) of a support (7,17). According to the invention, the second head (8) of the eyelet is provided with a seat (14) suitable to receive the folded edge (16,18) of the shank (4), in which the size of the aforesaid folded edge is variable as a function of the thickness of the support (7,17). In comparison with known eyelets for leatherwear and for clothing in general, the eyelet according to the invention offers the advantage that, while preventing the formation of unsightly excess thicknesses on the coupling section of the shank of the first head inside the hole of the second head of the eyelet.

8 Claims, 6 Drawing Sheets

(56) References Cited

U.S. PATENT DOCUMENTS

| | | | | |
|---|---|---|---|---|
| 2,143,087 | A * | 1/1939 | Rau, V | A43C 5/00 24/326 |
| 3,328,854 | A * | 7/1967 | Tombari | A44B 13/0082 135/119 |
| 3,399,435 | A * | 9/1968 | Ackerman, Jr. | A43C 5/00 16/2.1 |
| 3,512,224 | A * | 5/1970 | Newton | A43C 5/00 24/713.7 |
| 4,761,860 | A * | 8/1988 | Krauss | A43C 5/00 24/713.6 |
| 4,890,362 | A * | 1/1990 | Odajima | A43C 5/00 24/713.7 |
| 2012/0110803 | A1* | 5/2012 | Hasegawa | A44B 13/0082 24/713.6 |

OTHER PUBLICATIONS

English Abstract for JP 2014-200801 A dated Oct. 27, 2014.
English Abstract for KR 10-2011-0122019 A dated Nov. 9, 2011.
English Abstract for KR 10-2017-0058655 A dated May 29, 2017.

* cited by examiner

DOUBLE-SIDED EYELET WITH VARIABLE HEIGHT

BACKGROUND OF THE INVENTION

The present invention relates to a double-sided eyelet with variable height.

The field of the invention is that of double-sided eyelets, used in leatherwear and in clothing in general to decorate a through hole on a support made of leather, fabric and the like.

Conventionally, double-sided eyelets are formed by a first ring-shaped head provided with a shank, suitable to be housed inside the ring that forms the second head of the eyelet.

The height of the shank of the first head cannot be fixed, but must vary as a function of the thickness of the support, i.e., of the article that will receive the eyelet. This is necessary to prevent the formation of undesirable and unsightly folded edges on the surface of the eyelet.

Consequently, prior art eyelets must be prepared and stored with a large variety of first heads with shank of different height, i.e., that take account of the thickness of the support to which the eyelet will be attached.

Added to this is the fact that, in order to prevent the free end of the shank of the first head from projecting beyond the plane of the second head, the aforesaid height must not exceed the size strictly necessary to completely pass through the hole of the eyelet.

This means that there is no actual edge of the shank, capable of folding over on the second head of the eyelet to ensure effective grip and stability of the coupling on the support.

SUMMARY OF THE INVENTION

The main object of the present invention is to provide an eyelet with variable height, i.e. such as to be able to adapt to different thicknesses of the support material.

A further object of the invention is to provide an eyelet of the aforesaid type which, unlike similar prior art products, is capable of providing the necessary grip on the support.

Another object of the invention is to provide an eyelet of the type described above, designed to receive a cap-shaped head for closing the hole of the eyelet, with permanent attachment and preferably with anti-rotational behaviour.

These and other objects are achieved with the eyelet of claim 1.

Preferred embodiments of the eyelet of the invention are disclosed in the remaining claims.

In comparison with known eyelets for leatherwear and for clothing in general, the eyelet according to the invention offers the advantage that, while preventing the formation of unsightly excess thicknesses on the coupling section of the shank of the first head inside the hole of the second head of the eyelet, the height of the eyelet of the invention can be varied as a function of the thickness of the support. In this way it is not necessary to provide eyelets with heads having shanks of different height as a function of the thickness of the support that receives them.

The eyelet of the invention also offers the advantage that, due to the engagement of the edge of the free end of the shank of the first head inside its seat in the second head, it ensures the effective tear-resistance of the coupling.

The eyelet of the invention also has the advantage that, once applied to high or thinner thicknesses, it maintains the desired continuity between the inner diameter of the shank of the first head of the eyelet and the inner diameter of the shank of the second head. In this way, insertion of a cap and the like to close the through hole on the second head of the eyelet is facilitated.

The eyelet of the invention also has the advantage of comprising a cap-shaped head for closing the hole of the eyelet with anti-rotational properties, thus being capable of maintaining the desired orientation of the visible part of the cap of the cap-shaped head on the eyelet.

BRIEF DESCRIPTION OF THE DRAWINGS

These and other objects, advantages and characteristics are apparent from the following description of a preferred embodiment of the eyelet of the invention, illustrated by way of non-limiting example in the figures of the accompanying drawings, wherein.

DESCRIPTION OF PREFERRED EMBODIMENTS

Figure 1:
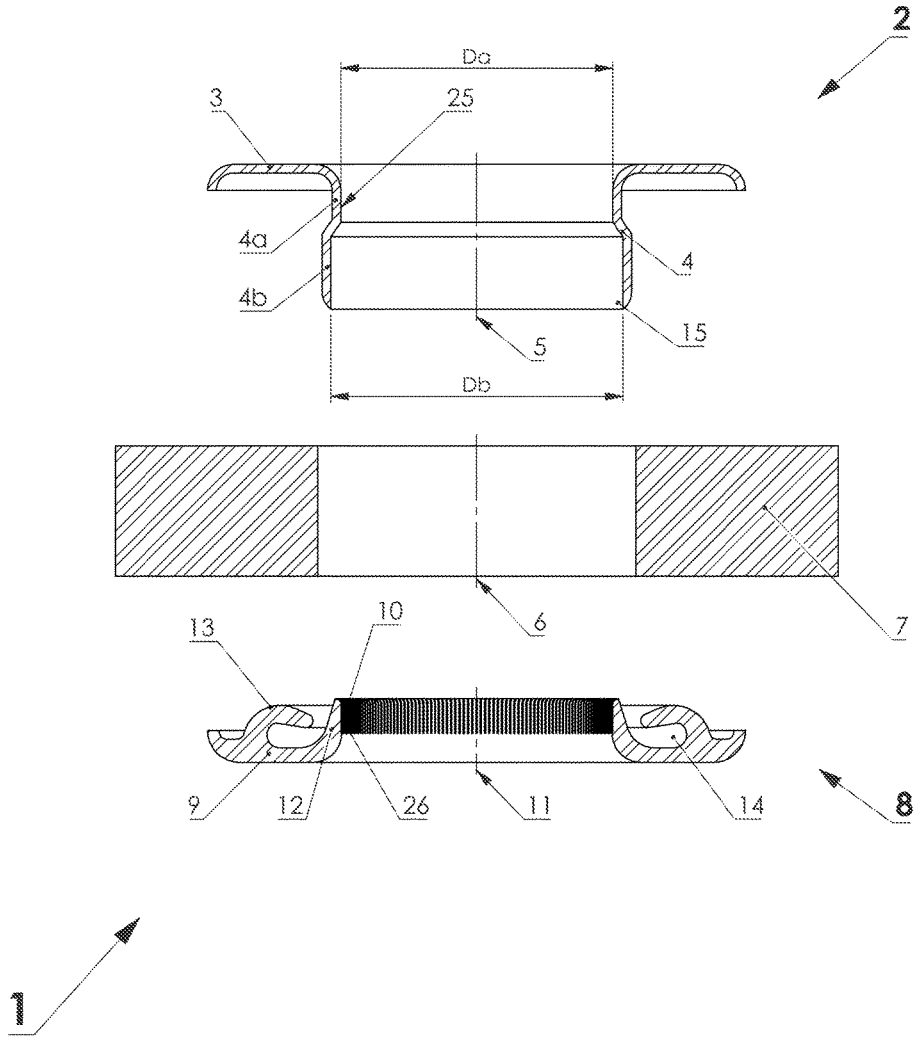
FIG. 1 shows a cross-sectional and exploded view of the eyelet of the invention.

The eyelet of the invention is indicated with 1 in FIG. 1 and comprises a first head 2 provided with an element 3, for example a circular ring, from which a cylindrical shaped shank 4 with an inner hole 5 extends. The shank 4 of the first head 2 of the eyelet 1 is in particular intended to pass through the hole 6 of the support 7.

According to the invention, the shank 4 of the first head 2 has two portions, 4*a* and 4*b* respectively, where the portion 4*b* is the one facing the hole 6 of the support 7 to which the eyelet 1 is to be attached. The same portion 4*b* also has a diameter Db, larger than the diameter Da of the aforesaid portion 4*a*.

The eyelet of the invention also comprises a second head 8 formed by a ring-shaped element 9, which in turn has an inner shank 10 of lesser height com-pared with the shank 4 of the head 2 and also provided with an inner hole 11.

In a position facing the outer wall 12 of the shank 10, the aforesaid head 8 has a wall element 13 that, in combination with the same wall 12 of the shank 10, defines and forms a groove 14.

Figure 2:
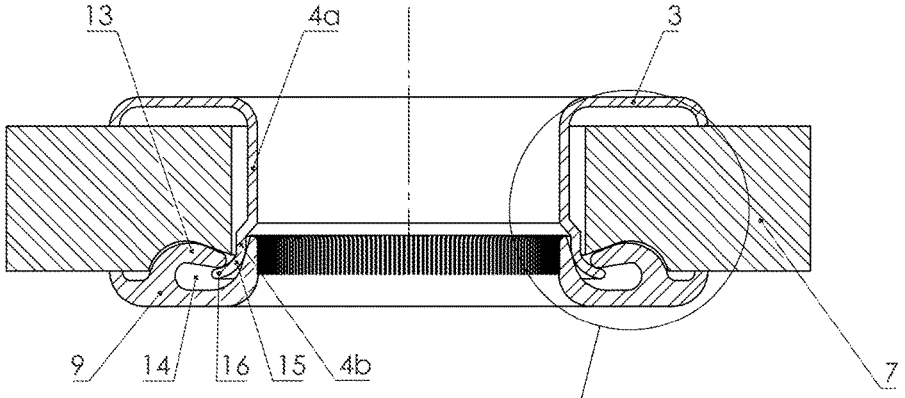
FIGS. 2 and 3 show the eyelet of FIG. 1, as applied to a high thickness support.
Figure 3:
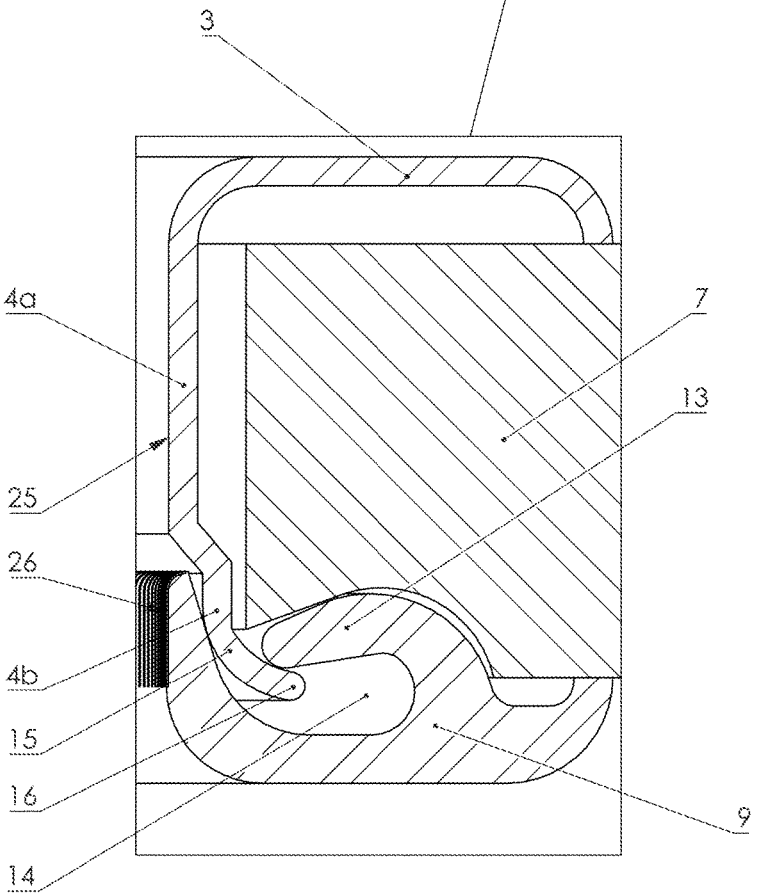

When applied to the high thickness support 7 shown in FIGS. 2 and 3, the edge 15 of the portion 4*b* having a diameter Db larger than the shank 4 of the head 2 is housed inside the groove 14 of the second head 8 thus forming a folded edge 16 that, by interfering with the aforesaid annular element 13 of the head 8, provides the mechanical seal between the heads 2 and 8 of the eyelet 1 on the support 7.

Figure 4:
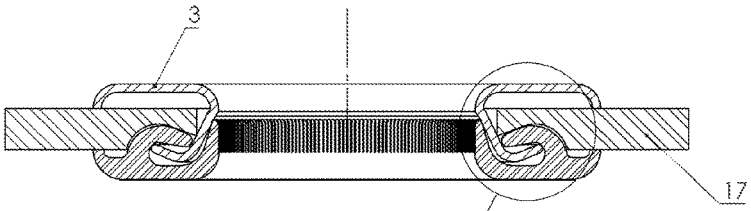
FIGS. 4 and 5 show the eyelet of FIG. 1, as applied to a thin support.
Figure 5:
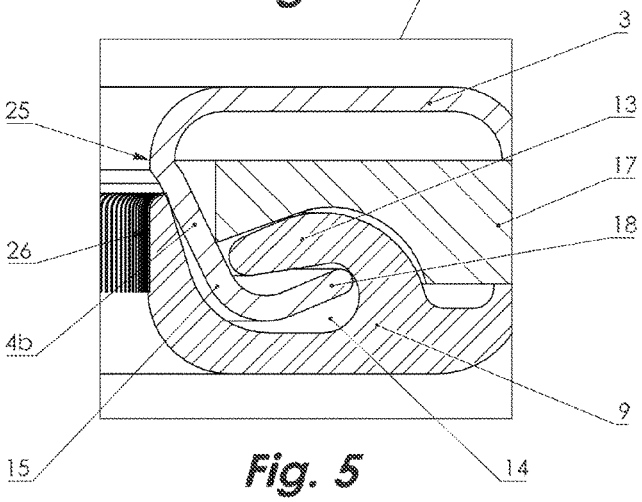

Instead, when applied to the support 17 of FIGS. 4 and 5, which is thinner than the support 7 of the preceding figures, the edge 15 of the portion 4*b* of the shank 4 of the head 2 forms a folded edge 18 that is formed by a length of shank greater than that deformed when the eyelet is applied to the thicker support 7 of FIGS. 2 and 3.

To this end, the groove 14 of the head 8 will be sized so as to be able to receive the different sizes of the folded edges 16,18 of the shank 4 that are formed in the two types of coupling described above.

Therefore, it can be understood how, due to the invention, the coupling with deformable shank of the head 2 inside the groove 14 of the head 8 allows the size of a single eyelet 1 to be adapted to supports 7 and 17 having different thickness.

Moreover, as can be seen in the aforesaid figures, insertion of the shank 4 of the first head 2 inside the groove 14 of the second head 8, due to the structure of the shank 4 in portions 4*a* and 4*b* of different diameter, maintains the continuity between the coupled inner surfaces, the inner surface 25 of the portion 4*a* of shank 2 and the inner surface 26 of the shank 10, respectively. In this way insertion of a cap or other closing accessories inside the hole 11 of the shank 10 is facilitated.

Figure 6:
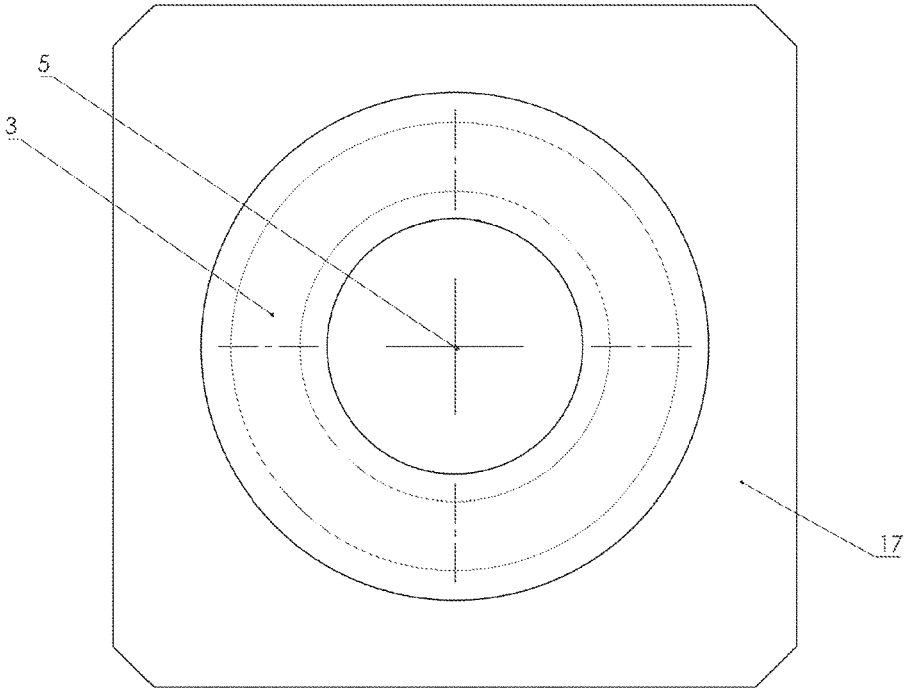
FIG. 6 shows a plan view of the eyelet of the invention, as assembled on a support.

The plan view of the eyelet of the invention on a support 7 or 17 is shown in FIG. 6.

Figure 7:
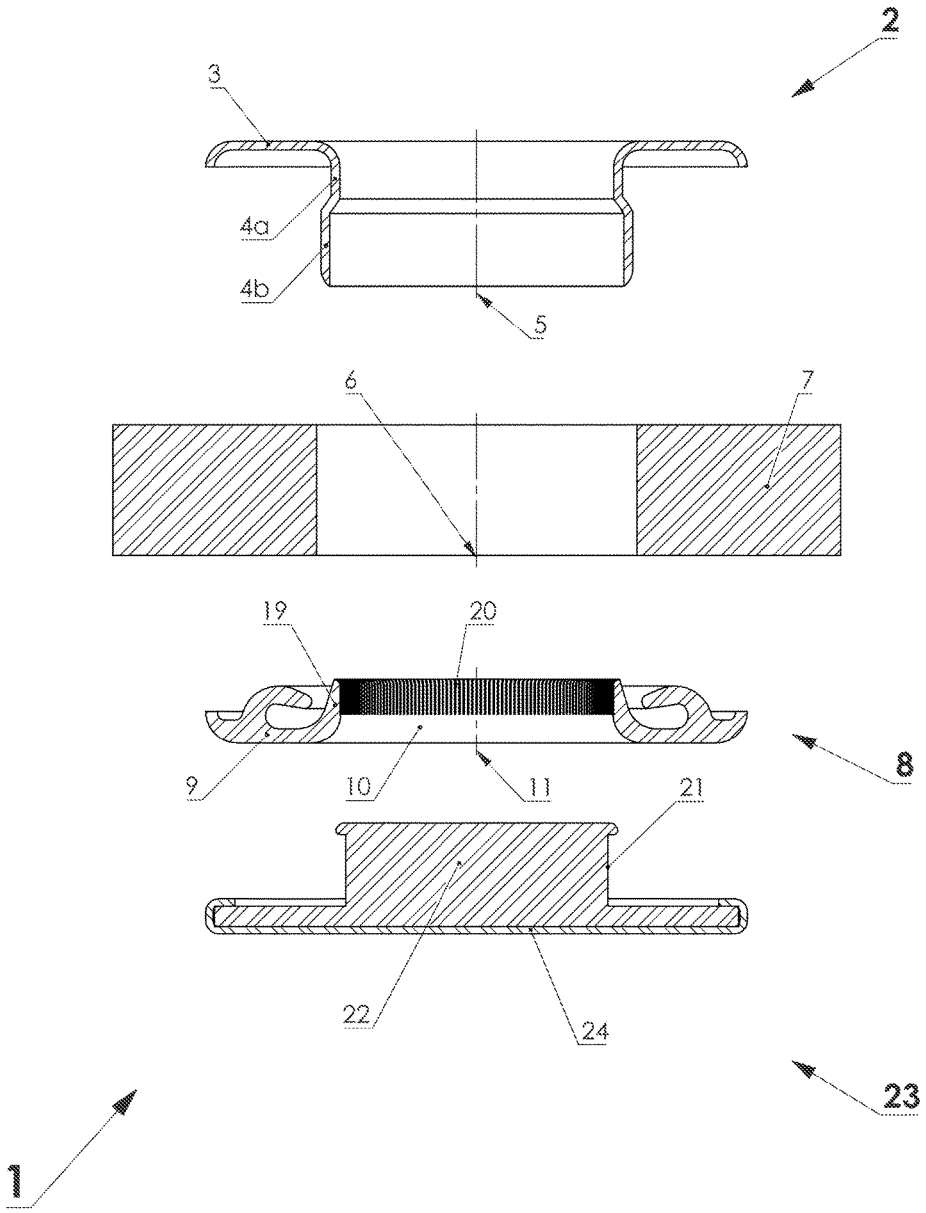
FIG. 7 shows a cross-sectional and exploded view of the eyelet of the invention, integrated with a cap-shaped head.
Figure 8:
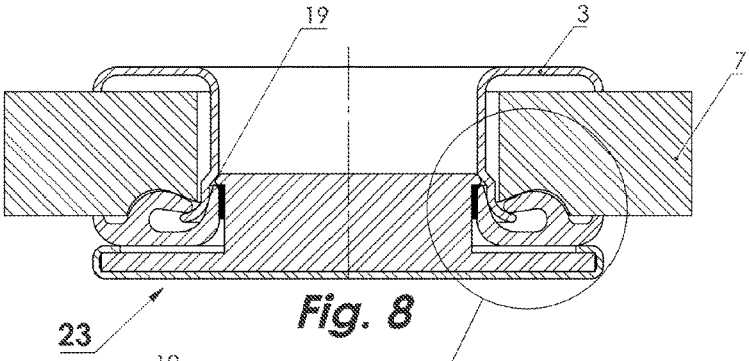
FIGS. 8 and 9 show the eyelet of FIG. 7, as applied to the related support.
Figure 9:
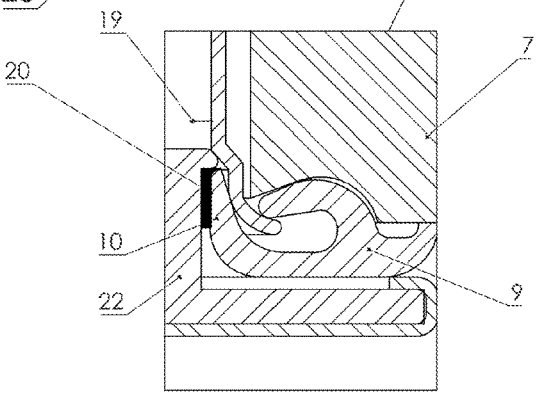
Figure 10:
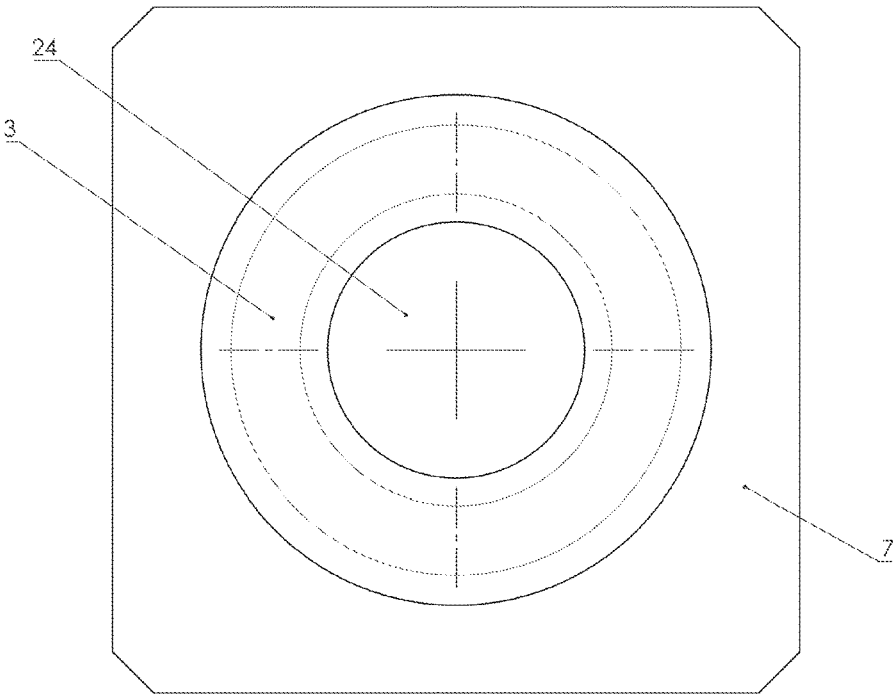
FIG. 10 shows a plan view of the eyelet of FIGS. 8 and 9.

In the mode of application of the eyelet of the invention illustrated in FIG. 7, the edge 19 of the shank 10 of the head 8 has faceted portions 20, designed to cooperate with the outer wall 21 of the shank 22 of a cap-shaped head 23 that identifies a closing device of the hole 11 of the eyelet 1.

In particular, said cap-shaped head 23 has a visible cap 24, with ornamental patterns.

In use, the shank 22 of the cap-shaped head 23 is inserted into the hole 11 of the second head 8 of the eyelet applied to the support 7 or 17. According to the invention, the aforesaid insertion is facilitated by the described structural continuity between the contiguous walls 25 and 26, of the portion 4*a* of shank 4 of the head 2 and of the shank 10 of the head 8, respectively.

Forced engagement of the shank 22 in the aforesaid hole 11 produces the interference of the wall 21 of the same shank 22 with the facets 20 of the edge 19 of the shank 10 of the second head 8, thus preventing accidental relative rotations of the cap-shaped head 23 inside the eyelet 1, susceptible of modifying the orientation of the cap 24 with the ornamental pattern.

The diameter of the shank 22 of the cap-shaped head 23 will also be proportionate to the corresponding diameter of the hole 11 of the shank 10 of the second head 8, so as to allow not only coupling between these parts, but also easy extraction of the same cap-shaped head 8 from the eyelet 1, thus allowing the desired replacements of the cap-shaped head.

Figure 11:
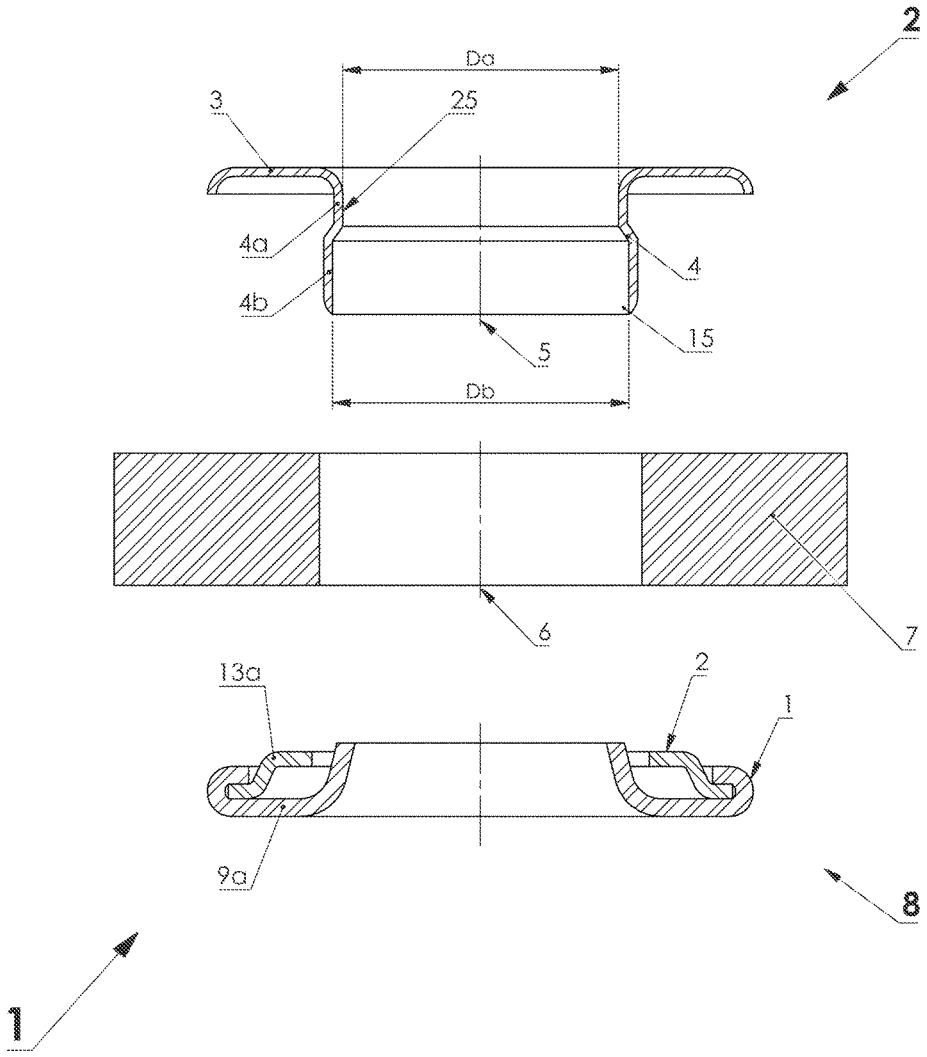
FIG. 11 shows a variant of embodiment of the eyelet of the preceding figures.

In the variant illustrated in FIG. 11, the ring 9*a* and the annular element 13*a*, both of the head 8, are provided as separate components and not in one piece.

The invention, as described above and illustrated in the accompanying drawings, can be modified to produce variants, which nonetheless fall within the scope of the claims below.

Thus, for example, the overall shape of the eyelet of the invention and of the related components can be other than circular, for example it can be oval, polygonal and the like.

Moreover, the facets 20 on the edge 19 of the shank 10 of the second head 8 can be replaced with different components which are nonetheless capable of engaging on the shank 22 of the cap-shaped head 23, in order to prevent relative rotations.

To this end, it is possible to use projecting inner teeth, notches on the edge 19 of the shank 10, knurls and the like.

The invention claimed is:

1. A double-sided eyelet, comprising a first head (2) provided with a first ring-shaped element (3) and a first shank (4), said first shank (4) having a first inner hole (5), and a second head (8) provided with a second ring-shaped element (9, 9*a*) and a second shank (10), said second shank (10) having a second inner hole (11), the first and second heads (2,8) being mutually closable on a hole (6) of a support (7,17), said first shank (4) of said first head (2) having two shank portions (4*a*,4*b*) comprising a first shank portion (4*a*) extending directly from said first ring-shaped element (3) and a second shank portion (4*b*) extending from said first shank portion (4*a*) distally from said first ring-shaped element (3), said second shank portion (4*b*) having a diameter (Db) larger than a diameter (Da) of said first shank portion (4*a*), said second head (8) being provided with a seat (14) adapted to receive a folded edge (16,18) of an end of said second shank portion (4*b*) of said shank (4) when said first and second heads (2,8) are mutually closed on the hole (6) of the support (7,17) whereby a size of said folded edge (16,18) being variable as a function of a thickness of said support (7,17).

2. An eyelet according to claim 1, wherein said second ring-shaped element (9,9*a*) of said second head (8) also comprises a wall element (13,13*a*) that forms, with a corresponding facing outer wall (12) of said second shank (10), said seat (14).

3. An eyelet according to claim 2, wherein said seat (14) consists of a groove sized as to receive said folded edge (16,18) of the end of said second shank portion (4*b*) of the shank (4) of said first head (2).

4. An eyelet according to claim 2, wherein said second ring-shaped element (9*a*) and said wall element (13*a*) are mutually separate components not provided in one piece.

5. An eyelet according to claim 1, wherein said second shank (10) of the second head (8) has an edge (19) provided with facets, knurls and notches (20).

6. A device for closing the eyelet according to claim 1, further comprising a cap-shaped head (23) comprising a cap (24) having a cap shank (22), an outer wall (21) of said cap shank (22) engaging with an anti-rotational coupling on an edge (19) of said second shank (10) of the second head (8).

7. A device according to claim 6, wherein said cap (24) has an ornamental pattern on an exposed surface thereof.

8. A device according to claim 6, wherein a coupling of the cap-shaped head (23) with said second shank (10) of the second head (8) of the eyelet (1) is removable.

* * * * *